US005695372A

United States Patent [19]

Hilleren

[11] Patent Number: 5,695,372

[45] Date of Patent: Dec. 9, 1997

[54] SLALOM WATERSKIING HANDLE POSITIONING DEVICE

[76] Inventor: David Hilleren, 830 N. Atlantic Ave., B-1008, Cocoa Beach, Fla. 32931

[21] Appl. No.: 686,608

[22] Filed: Jul. 26, 1996

[51] Int. Cl.[6] ..... A63C 15/06

[52] U.S. Cl. ..... 441/69; 114/253

[58] Field of Search ..... 441/69, 73; 114/39.1, 114/39.2, 253, 254

[56] References Cited

U.S. PATENT DOCUMENTS

| | | | |
|---|---|---|---|
| 4,263,685 | 4/1981 | Neuscheler | 9/310 |
| 4,280,240 | 7/1981 | Neuscheler | 9/310 |
| 4,400,831 | 8/1983 | Rietz | 2/161 |
| 4,508,045 | 4/1985 | Spanier | 114/39.2 |
| 4,720,279 | 1/1988 | Fritschen et al. | 441/69 |
| 4,981,098 | 1/1991 | Lickle | 114/253 |
| 4,981,455 | 1/1991 | Lickle | 441/73 |
| 5,243,710 | 9/1993 | Craycroft | 2/312 |
| 5,342,266 | 8/1994 | Dailey | 482/71 |
| 5,449,309 | 9/1995 | McCarty | 441/69 |

FOREIGN PATENT DOCUMENTS

| | | | |
|---|---|---|---|
| 2639606 | 6/1980 | France | 114/39.2 |
| 3232908 | 3/1984 | Germany | 114/39.2 |

*Primary Examiner*—Stephen Avila

*Attorney, Agent, or Firm*—Brian S. Steinberger; Law Offices of Brian S. Steinberger

[57] ABSTRACT

A Slalom water skiing handle positioning method and device. Target patches such as hook and loop fasteners such as Velcro® are attached along the right and left front hips of a water skier and additionally on a tow rope handle. The locations of the target patches on the hip are selected to optimize where a water skier passing through wakes in a Slalom course usually uses when pulling a tow bar handle against their hip. The target patches can be attached to the hips by a waist belt having removable covers that expose the target patches or by directly attaching the target patches to the front of a wet suit worn by a water skier. The target patches can also be formed from reusable plastic and nylon tape, and plastic and metal snapable buttons.

18 Claims, 5 Drawing Sheets

Fig.2A
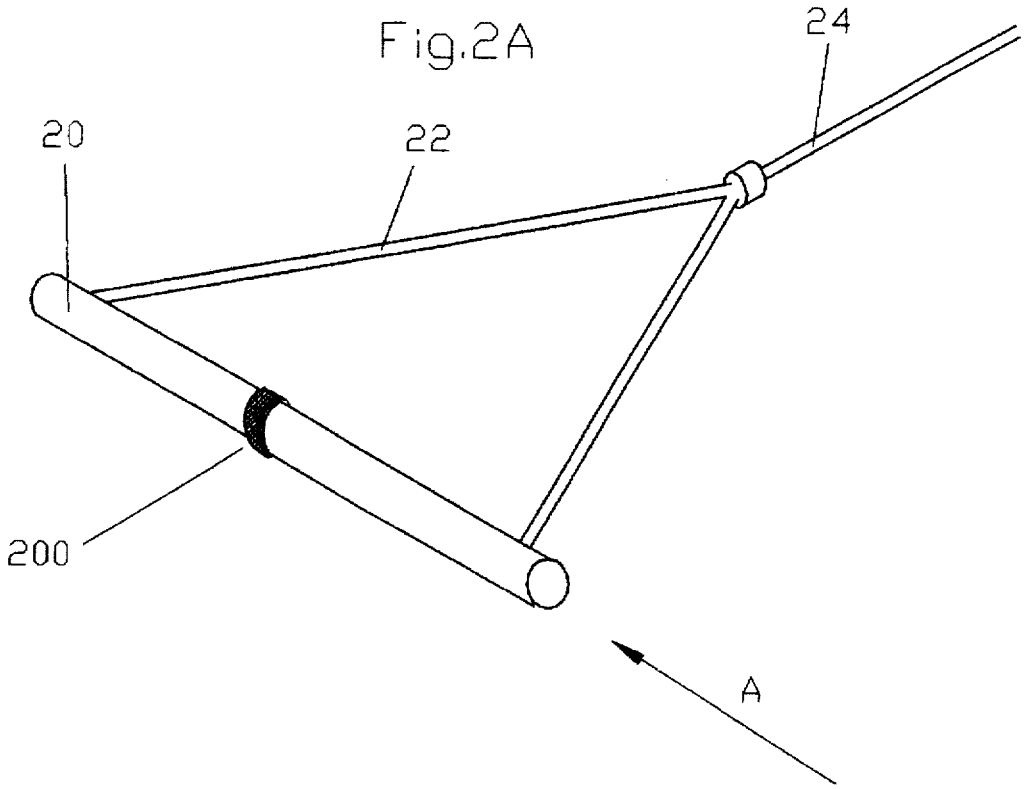
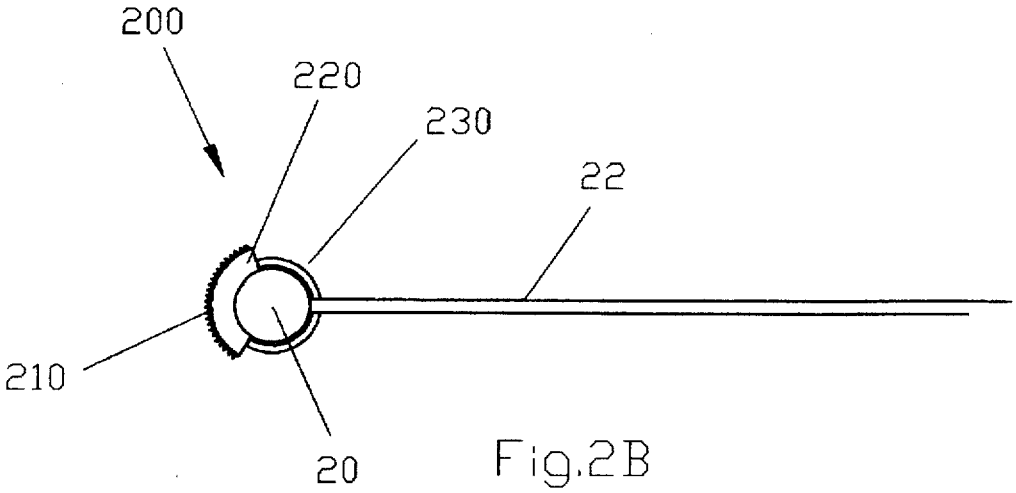
Fig.2B

SLALOM WATERSKIING HANDLE POSITIONING DEVICE

This invention relates to water skiing, and in particular to a method and device for allowing a water skier to optimize and continuously reuse the target position of the tow rope handle relative to a hip location while passing through slalom course.

BACKGROUND AND PRIOR ART

Slalom waterskiing is an amateur and professional sport which involves the skier negotiating a precise course. The water skier must pass through a starting gate, ski around approximately six buoys(three one each side) in a crisscross pattern and then pass through an exit gate. Great balance, skill, strength, and timing is involved. A key feature to a successful pass is the initiation of the "pull" which accelerates the skier across the boat wakes to the next buoy.

A successful "pull" requires a proper body position or lean away from the boat and the proper position of the rope handle with respect to the body. Ideally, the rope handle is pulled to the hips and held in this position as the skier accelerates across the wake. When the handle is out of position(away or forward of the hip), the skier cannot achieve his ideal "lean" position away from the boat and angle of attack across the wakes.

Various types of U.S. patents have been proposed for use with a tow rope handle and a water skier. See U.S. Pat. Nos. 4,263,685 and 4,280,240 to Neuscheler; 4,400,831 to Rietz; 4,720,279 to Fritschen et al.; 4,981,098 to Lickle; 4,981,455 to Tubens; 5,243,710 to Craycroft; 5,342,266 to Dailey; and 5,449,309 to McCarty. However, none of the prior an addresses nor helps a Slalom water skier with the location of their tow rope handle and where it should meet the body area.

SUMMARY OF THE INVENTION

The first objective of the present invention is to provide a method for achieving the proper position of a tow rope handle against a skiers hip while slalom waterskiing.

The second objective of the present invention is to provide a device for achieving the proper position of a tow rope handle against a skiers hip while slalom waterskiing.

The third object of this invention is to provide a detachable reusable fasteners for attaching and detaching a tow rope handle to a target location on a water skier's hip during slalom water skiing.

A preferred embodiment includes hook and loop patches such as Velcro®, which function as targets that are worn at the proper level on the hips via a belt which is wrapped about water-ski apparel such as a wet suit. The exact position of this target on the belt can vary depending on the skier's body habitus and center of gravity. A mating exterior raised hook and loop ridge patch such as Velcro® is attached onto the center of the handle. A second embodiment has hook and loop patches directly affixed to the wet suit instead of the belt.

In use, the skier makes their turn around the buoy and, at the end of the turn, pulls the raised hook and loop patch on the handle to the hook and loop target on the hips. The skier then holds that position across each of the wakes. The hook and loop patches will separate when the body and handle position are unneeded to cross the wakes, at which point the skier can hear the "pop" and "rip" of the hook and loop fasteners separating from one another. When proper position is held across the boat wakes, the proper instant of handle repositioning is repeated by the connection described above.

In addition to the hook and loop fasteners the invention can use reusable two-sided plastic and nylon tape, and metal and plastic snapable buttons as the target patches.

The proper body position of the skier using the subject invention allows for the transmission of the force of the pull rope along the skier's axial spine. Improper position(such as the skier bending over) causes a forward force on the skier's shoulders leading to the bending of the skier's waist (breaking). Thus, improper position pulls the shoulders forward producing severe force on the back muscles and ligaments which can lead to severe injuries to the skier.

Further objects and advantages of this invention will be apparent from the following detailed description of a presently preferred embodiment which is illustrated schematically in the accompanying drawings.

BRIEF DESCRIPTION OF THE FIGURES

FIG. 2A is a perspective view of a water ski handle and tow rope having a novel hook and loop fastener target patch.

FIG. 2B is a side view of the handle and hook and loop target patch of FIG. 2A along arrow A.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1B:
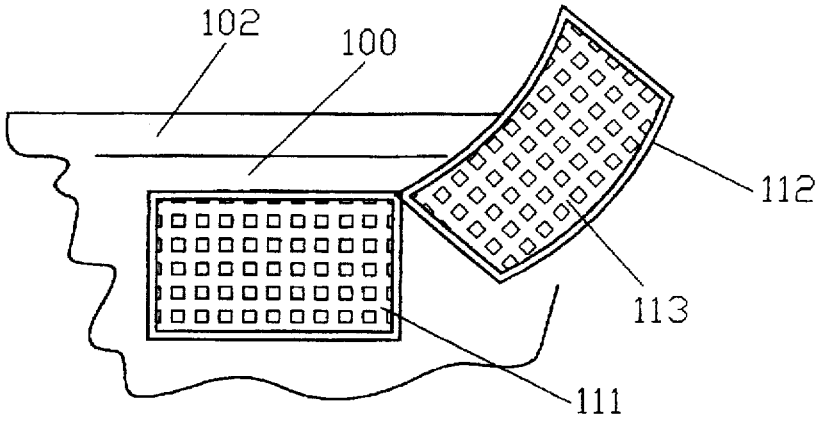
FIG. 1B is an enlarged view of a removable cover over a hook and loop fastener patch of FIG. 1A.
Figure 1A:
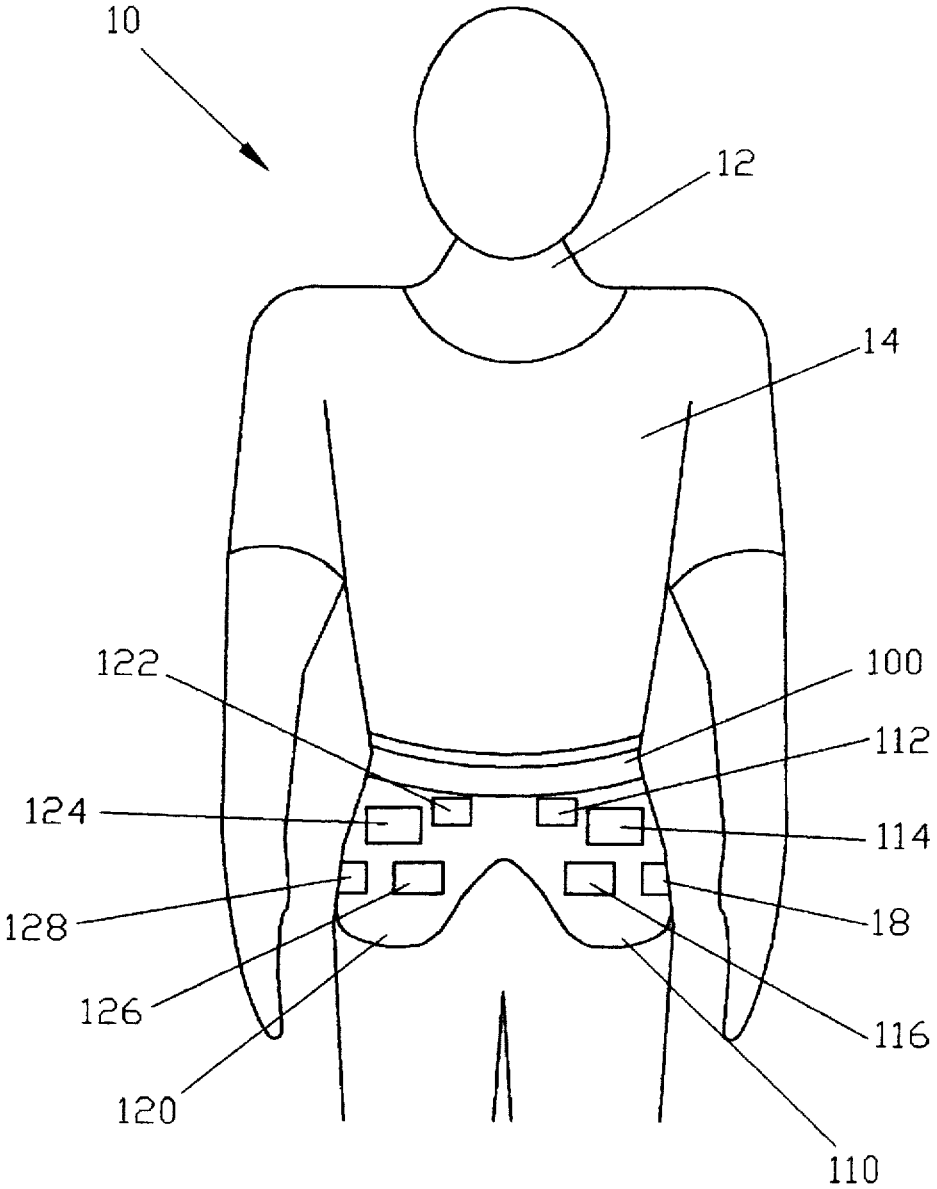
FIG. 1A is a front perspective view of a belt worn by a Slalom water skier having removable covers over hook and loop fasteners.

FIG. 1A is a front perspective view 10 of a belt 100 worn by a Slalom water skier 12 having removable covers 112, 114, 116, 118 on a left front hip side portion and removable covers 122, 124, 126, 128 on a right front hip side portion of belt 100. FIG. 1B is an enlarged view of the removable cover 112 having an interior surface of hook and loop fasteners 113 which can cover and attach to hook and loop patch 111 on the waist belt 100. Each of the remaining covers are similarly constructed and differ only as to their location about the right and left front hip portions on the belt 100. The hook and loop fasteners can be commercially available Velcro®, and the like and hook and loop fasteners of FIG. 1A. Belt 100 can be formed of the same rubber and nylon materials used in a conventional wet suit 14 and have side flaps 110 and 120 over the left side and right side of the skier's hip. An elastic band 102 can additionally be used to better hold the belt 100 about the waist of the skier. Users of the belt 100 can determine over practiced Slalom course runs which left and right hip front patches should be selected.

FIG. 2A is a perspective view of a water ski handle 20 and tow rope connections 22, 24 having a novel hook and loop fastener target patch 200 thereon. FIG. 2B is a side view of the handle and hook and loop target patch 200 of FIG. 2A along arrow A. Referring to FIGS. 2A–2B, handle patch 200 includes an hook and loop fastener surface 210 attached to a raised plastic ridge support 22 having an interior surface for being curved about a tow handle 20 with a detachable strap 230 for holding the target patch 200 to the handle 20. Strap 230 can be two parts with hook and loop fasteners on ends for completing the attachment of the strap about the handle 20. The orientation of the target patch 200 is to position the hook and loop fasteners in the direction of the Slalom water skier.

Figure 3:
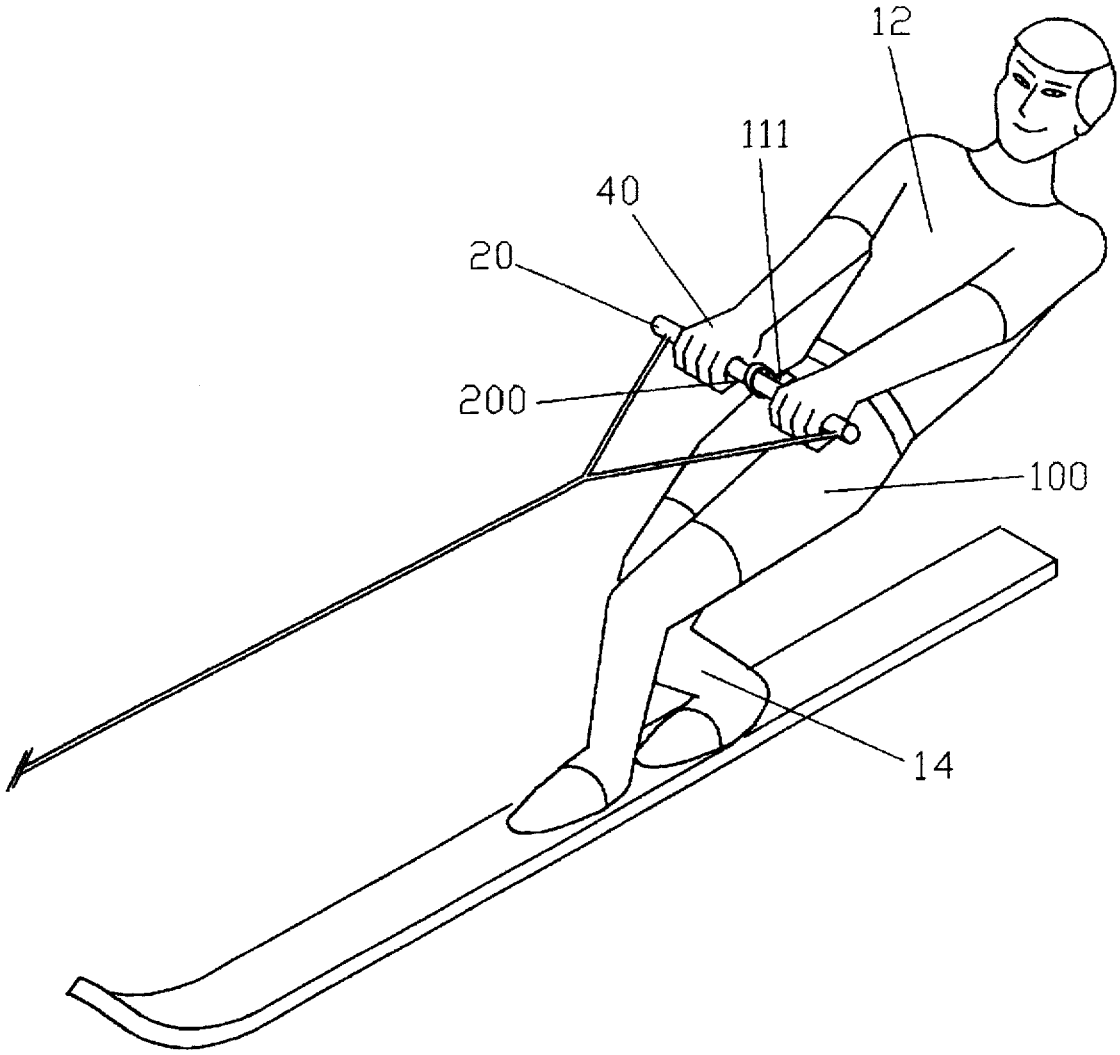
FIG. 3 is a perspective view of the Slalom water skier and belt of FIG. 1A along holding onto the water ski handle and target patch of FIG. 2A on a Slalom board.

FIG. 3 is a perspective view of the Slalom water skier 12 wearing the belt 100 of FIG. 1A over a wet suit 14 while hand holding 40 the water ski handle 200 and target patch 200 of FIG. 2A in contact over a hip area together on a Slalom board 30.

Figure 4B:
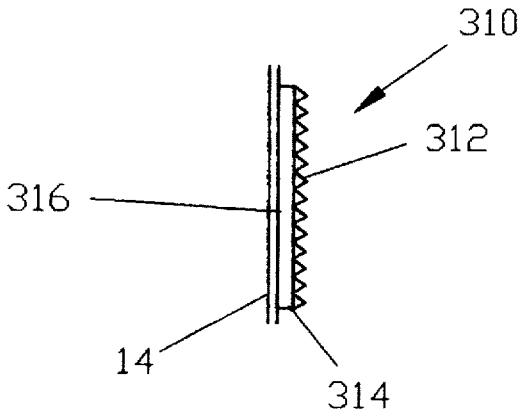
FIG. 4B is a side cross-sectional view of a single target patch of FIG. 4A.
Figure 4A:
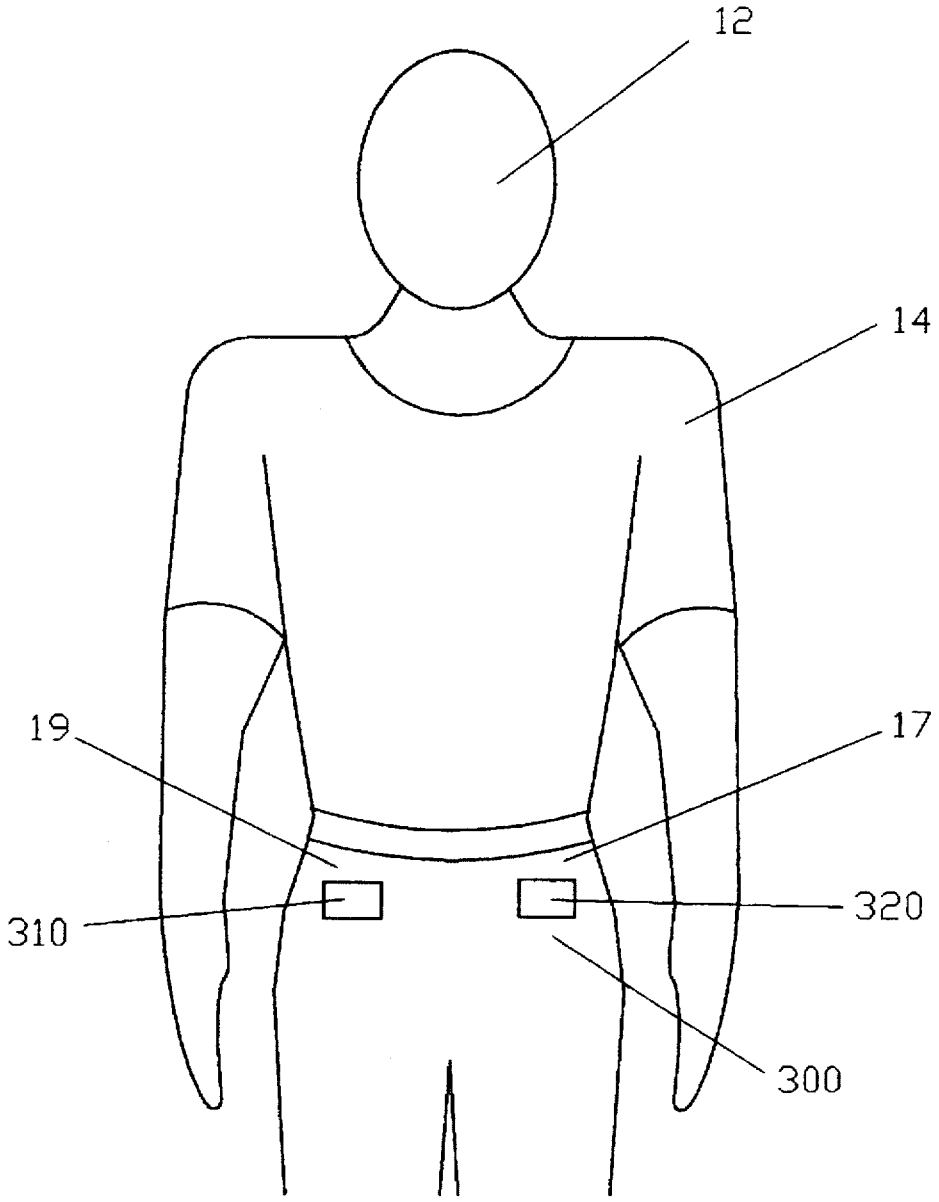
FIG. 4A is a front perspective view of a second embodiment of having removable target patches on the front hip areas of a Slalom water skier.

FIG. 4A is a front perspective view of a second embodiment 300 of having removable target patches 310, 320 on the left and right front hip areas 17, 19 of a Slalom water skier 12. FIG. 4B is a side cross-sectional view of a single target patch 310 of FIG. 4A. Referring to FIGS. 4A–4B, target patches can include square and rectangular patches 310, 320. Each patch 310, 320 can include exterior exposed hook and loop fasteners 312, nylon/plastic backing 314 and reusable glue adhesive side 316 which sticks onto wet suit material 14.

Figure 5:
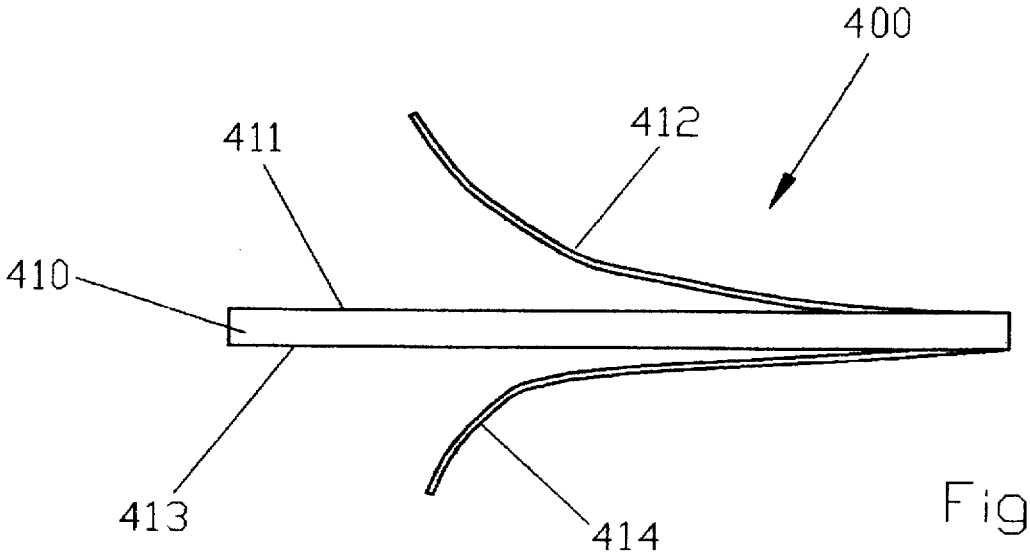
FIG. 5 is a side view of an alternative embodiment of using two sided plastic tap as a reusable fastener with the subject invention.

FIG. 5 is a side view of an alternative embodiment 400 of using two sided plastic tape as a reusable fastener with the subject invention. Two sided tape 400 can be commercially available plastic or nylon tape backing 410 having double adhesive surfaces 411,413 with respective plastic or nylon cover flaps 412, 414. The two sided tape can be substituted for the hook and loop fasteners described in the previous Figures, and used in a similar manner.

Figure 6:
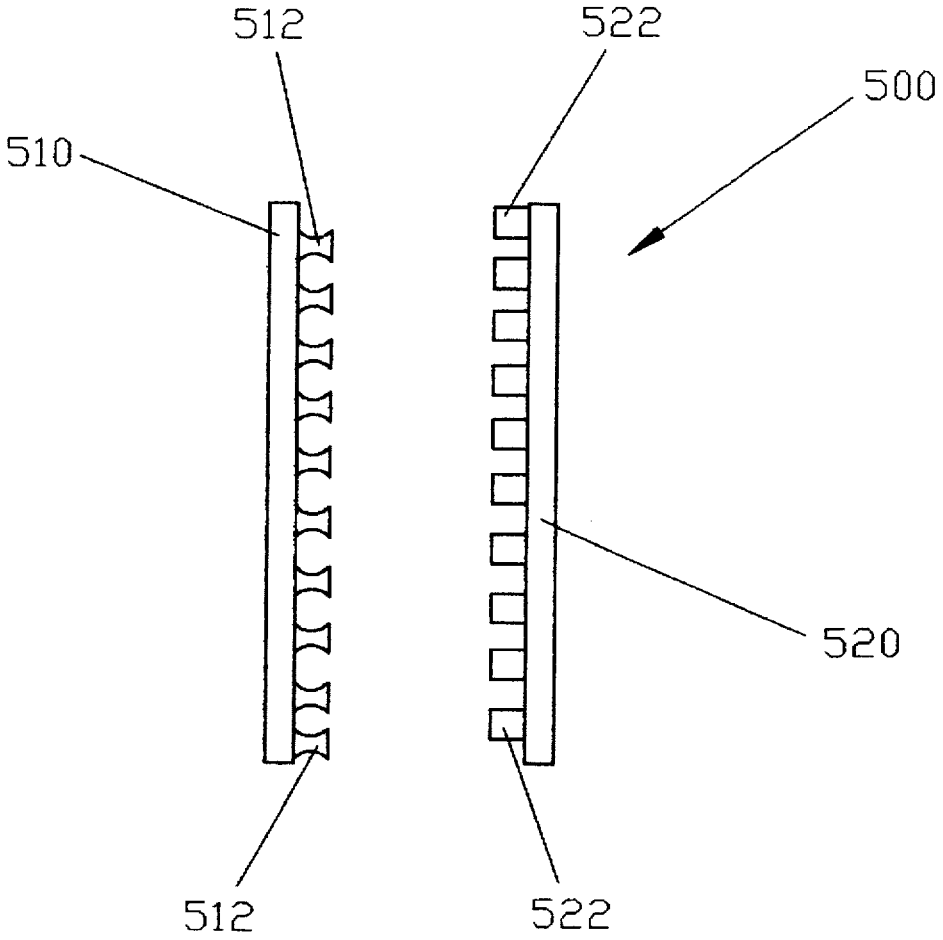
FIG. 6 is a side view of another alternative embodiment of using snapable buttons as a reusable fasteners with the subject invention.

FIG. 6 is a side view of another alternative embodiment 500 of using snapable buttons having socket portions 512 connected to square or rectangular resilient base 510 such as nylon or plastic, and mateable caps 522 attached to another resilient base. The snappable buttons embodiment can be used in place of the hook and loop fasteners described in the previous embodiments.

While the preferred embodiment describes utilizing hook and loop fasteners such as "Velcro®, the invention can be used with other types of detachable reusable fasteners such as but not limited to two sided plastic or nylon tape, metal and plastic snap buttons, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of achieving proper position of a tow rope handle against a skiers hip while slalom waterskiing, comprising the steps of:

(a) attaching first detachable fasteners to a left front side hip portion and to a right front hip portion of a water skier; and (b) attaching second detachable fasteners onto a tow rope handle, the first detachable fasteners and the second detachable fasteners being attachable and detachable to one another and reusable over time, wherein the first detachable fasteners and the second detachable fasteners attach to one another during a pass of slalom waterskiing.

2. The method of achieving proper position of claim 1, wherein the first detachable fasteners step (a) further includes:

wrapping a belt having the first detachable fasteners around a hip and waist area of the water skier.

3. The method of achieving proper position of claim 2, wherein the belt further includes:

removable covers for exposing the first detachable fasteners on front right and front left hip portions.

4. The method of achieving proper position of claim 1, wherein the first detachable fasteners step (a) further includes:

attaching the first detachable fasteners onto a wet suit worn by the water skier.

5. The method of achieving proper position of claim 1, wherein the fast detachable fasteners and the second detachable fasteners each includes:

hook and loop fasteners.

6. The method of achieving proper position of claim 1, wherein the first detachable fasteners and the second detachable fasteners each includes:

reusable two-sided tape.

7. The method of achieving proper position of claim 1, wherein the first detachable fasteners and the second detachable fasteners each includes:

mateable snap buttons.

8. A device for achieving proper position of a tow rope handle against a skiers hip while slalom waterskiing, comprising:

first reusable fasteners attached about a left front side hip portion and a right front side hip portion of a water skier; and second reusable fasteners attached onto a tow rope handle, the first reusable fasteners and the second reusable fasteners being attachable and detachable to one another and reusable over time, wherein the first reusable fasteners and the second reusable fasteners attach to one another during a pass of slalom waterskiing.

9. The device for achieving proper position of claim 8, wherein the first reusable fasteners include:

a waist belt supporting the first detachable fasteners on an outer surface.

10. The device for achieving proper position of claim 8, wherein the waist belt includes:

removable covers for exposing the first detachable fasteners on front right and front left hip portions.

11. The device for achieving proper position of claim 8, wherein the first reusable fasteners include:

a first surface having the reusable fasteners exposed and a rear surface attached onto a wet suit worn by the water skier.

12. The device for achieving proper position of claim 8, wherein the first reusable fasteners include:

hook and loop fasteners.

13. The device for achieving proper position of claim 8, wherein the first reusable fasteners include:

reusable two-sided tape.

14. The device for achieving proper position of claim 8, wherein the first reusable fasteners include:

mateable snap buttons.

15. A Slalom water skiing handle positioning device comprising:

at least one set of hook and loop fastener target patches attached about a right front side hip portion and about a left front hip portion of a water skier; and a single hook and loop fastener target patch attached onto a mid portion of a tow rope handle forming a raised ridge, the set of hook and loop fastener target patches and the tow rope handle hook and loop fastener target patch being attachable and detachable to one another and reusable during a pass of slalom waterskiing.

16. The Slalom water skiing handle positioning device of claim 15, further comprising:

a waist belt supporting the set of hook and loop fastener target patches; and a first set removable covers on the waist belt for exposing the set of hook and loop fasteners.

17. The Slalom water skiing handle positioning device of claim 16, wherein the belt includes:

a second set of removable covers on the waist belt for exposing at least one additional set of hook and loop fasteners, wherein the water skier selects at least one right front hip side and one left front side removable cover.

18. The method of achieving proper position of claim 1, further comprising the steps of:

(c) attaching the first detachable fasteners to the second detachable fasteners, wherein proper body position during the pass of slalom waterskiing allows the force of the tow rope handle to be transmitted to the axial spine of the waterskier.

* * * * *